US010896798B2

(12) United States Patent
Repenning

(10) Patent No.: US 10,896,798 B2
(45) Date of Patent: Jan. 19, 2021

(54) X-RAY UNIT

(71) Applicant: KONINKLIJKE PHILIPS N.V., Eindhoven (NL)

(72) Inventor: Thorben Repenning, Moorrege (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/322,504

(22) PCT Filed: Jul. 26, 2017

(86) PCT No.: PCT/EP2017/068820
§ 371 (c)(1),
(2) Date: Feb. 1, 2019

(87) PCT Pub. No.: WO2018/024553
PCT Pub. Date: Feb. 8, 2018

(65) Prior Publication Data

US 2019/0259558 A1 Aug. 22, 2019

(30) Foreign Application Priority Data

Aug. 1, 2016 (EP) ..... 16182175

(51) Int. Cl.
*H01J 35/16* (2006.01)
*H01J 35/14* (2006.01)
*H01J 35/30* (2006.01)

(52) U.S. Cl.
CPC ..... *H01J 35/16* (2013.01); *H01J 35/147* (2019.05); *H01J 35/153* (2019.05); *H01J 35/30* (2013.01); *H01J 35/14* (2013.01)

(58) Field of Classification Search
CPC ..... H01J 35/16; H01J 35/14; H01J 35/147; H01J 35/153; H01J 35/30
See application file for complete search history.

(56) References Cited

U.S. PATENT DOCUMENTS

| | | | |
|---|---|---|---|
| 3,331,978 | A | 7/1967 | Brown |
| 4,362,611 | A | 12/1982 | Logan |
| 5,528,652 | A | 6/1996 | Smith |
| 6,292,538 | B1 | 9/2001 | Hell et al. |
| 2014/0314197 | A1 | 10/2014 | Watanabe |
| 2015/0187538 | A1 | 7/2015 | Canfield |
| 2015/0380201 | A1 | 12/2015 | Yoshizawa |

FOREIGN PATENT DOCUMENTS

| | | | | | |
|---|---|---|---|---|---|
| DE | 725555 | C | * | 9/1942 | ..... H01J 35/32 |
| DE | 725555 | C | | 9/1942 | |
| DE | 879744 | C | | 6/1953 | |
| DE | 102013223787 | A1 | | 5/2015 | |
| JP | 2004138460 | A | | 5/2004 | |
| JP | 2004165052 | | | 6/2004 | |
| JP | 2010198744 | A | | 9/2010 | |

* cited by examiner

*Primary Examiner* — Chih-Cheng Kao
(74) *Attorney, Agent, or Firm* — Larry Liberchuk

(57) ABSTRACT

The invention relates to an X-ray unit, an X-ray system, and a method for manufacturing an X-ray system. The X-ray system comprises an X-ray unit, a cathode, and an anode. The X-ray unit comprises a vacuum tube and a magnet system. The vacuum tube is configured to encase a cathode, an anode, and a drift way for an electron beam moving between the cathode and the anode. The magnet system is configured to focus the electron beam and the magnet system is fused to the vacuum tube.

10 Claims, 5 Drawing Sheets

X-RAY UNIT

The invention relates to an X-ray unit, an X-ray system, and a method for manufacturing an X-ray system.

BACKGROUND OF THE INVENTION

X-ray imaging is applied in various technical fields in order to obtain information about internal structures within a region of interest of an object. For example, medical X-ray imaging devices are used to obtain information about internal structures within a patient's body.

For example, DE 10 2013 223 787 A1 discloses an X-ray tube with a vacuum housing including a cathode chamber with a cathode arrangement, an anode chamber with an anode arrangement, and a drift way disposed between the cathode chamber and the anode chamber. The drift way is surrounded by a self-supporting magnet arrangement comprising at least two pre-installed half shells.

A main problem of this half shell design is a rather weak stiffness. Mainly, the stiffness is determined by a small diameter of a so called bottle neck, which is the drift way of electrons between the cathode chamber and the anode chamber on their way to a target. The bottleneck has to have a small diameter and a low wall thickness. The small diameter is necessary to have the magnet arrangement near the electron beam to improve its influence on the electron beam. The low wall thickness is necessary to reduce induction losses. Both points, the small diameter and the low wall thickness cause the low stiffness in the area of the drift way.

Negative results of the low stiffness are, first, a moving and bending cathode of several kilograms under g-forces (e.g. 36 G) within a CT gantry and, second, a low eigenfrequency of the X-ray tube. Third, the area of the drift way has to be cooled by a cooling liquid and therefore the half shells have to be carefully sealed, which is rather expensive. Fourth, the two half shells need to be elaborately positioned to secure an acceptable accuracy of the X-ray tube, which still remains not optimal. Fifth, a yoke of the magnet arrangement is either one part, which then needs to be added when building the X-ray system and cannot be removed or adapted without disassembling the entire X-ray system or needs to be also separated into at least two parts, which causes a loss of magnetic field and accuracy.

DE725555C describes that with respect to a focusing device for x-ray tubes, it has been proposed to use the magnetic gap as an exit window for the usable radiation in the case of x-ray tubes. In this arrangement, the radiation occurs at an angle of approximately 45° to 90° relative to the anode tube axis at an angle perpendicular to the axis of the anode tube. With these arrangements, it is desirable to approach the focal spot as close as possible to the workpiece to be inspected. However, in DE72555C it is described that this approximation is limited by the focusing coil required for excitation of the magnetic field. In DE72555C it is described that this disadvantage is avoided in the described focusing device in that the magnetic back-up of the foliage coil, which is arranged on the side of the anode remote from the vacuum chamber, is located on the side where the radiation exits through it or through openings provided therein as a cone-pyramidal body, the axis of which approximately coincides with the axis of the anode tube. Equivalent caps, for example composed of spherical segments, can also be used as long as they allow the workpiece to be brought closer to the focal spot than a cylindrical tube from the outer diameter of the coil.

DE879744C relates to an x-ray tube with a controllable collection coil mounted near the anode for adjusting the spot size. Particularly in the case of X-ray tubes for the material examination, it is known to be able to use differently sized focal spots. It is described that by the glow cathode and by the anode of an X-ray tube, the regulation of the spot spot size of an x-ray tube without the undesired passage of the control can be achieved in that a controllable collecting coil located on the potential of the anode is arranged in the vacuum space of the x-ray tube on the anode side. It is described that the coil, which is connected to a supply current line at different current levels, can be operated so as to form a larger or smaller focal spot on the cathode in the region of the coil field.

U.S. Pat. No. 4,573,186A describes that in an X-ray tube having a glow cathode for emitting an electron beam, an anode, focusing and deflecting coils and a target in an evacuated envelope, the cathode is a U-bent filament the dimensions of which are large in relation to the electron emitting area. The cathode is heated by passing electric current through it and is differentially cooled so that a small surface area at the site of electron emission is at a substantially higher temperature than remaining surface areas of the cathode. Cooling is effected by a thick-walled cylindrical grid which surrounds the cathode and has at its outer end an annular inward projection which absorbs heat rays from the cathode. The grid has a funnel-shaped outer end surface having an included angle of about 100 DEG to 140 DEG. The electron emitting surface of the cathode lies approximately in a plane defined by the inner peripheral edge of the funnel-shaped end surface of the grid. The electric field applied to the cathode has its highest value at the small electron emitting surface of the cathode.

SUMMARY OF THE INVENTION

Hence, there may be a need to provide an X-ray unit, which provides in particular an improved performance.

The problem of the present invention is solved by the subject-matters of the independent claims, wherein further embodiments are incorporated in the dependent claims. It should be noted that the aspects of the invention described in the following apply also to the X-ray unit, the X-ray system, and the method for manufacturing such X-ray system. According to the present invention, an X-ray unit is presented. The X-ray unit comprises a vacuum tube and a magnet system. The vacuum tube is configured to encase a cathode, an anode, and a drift way for an electron beam moving between the cathode and the anode. The magnet system is configured to focus the electron beam and the magnet system is fused to the vacuum tube.

Fusing may be understood in that the magnet system is integrated into the vacuum tube, so that the vacuum tube and the magnet system form a closed unit. The magnet system does not comprise two half shells, but a mono shell. By means of the fusing, the magnet system and the vacuum tube are directly connected with each other and form only one part. For example, the magnet system is welded to the vacuum tube in an area of the drift way. Thereby, the magnet system is an integrational part of the vacuum tube, but is not arranged in the vacuum.

As a result, the stiffness of the X-ray unit in the area of the drift way is greatly improved. The increased stiffness may allow a better performance of the X-ray unit in particular in view of a higher g-force stiffness of the cathode in a CT gantry and a higher eigenfrequency. No sealing and elaborate positioning of single parts are necessary, while also a yoke of the magnet system can be one single, closed part. The accuracy is improved, while at the same time costs are reduced.

In an example, the fusing of the magnet system to the vacuum tube is based on a material connection. The fusing of the magnet system to the vacuum tube may be based on a local melting of the vacuum tube material. The fusing of the magnet system to the vacuum tube may be a welding or a soldering.

The magnet system surrounds the vacuum tube in an area of the drift way.

In an example, the magnet system comprises a deflection unit configured to magnetically focus and deflect the electron beam moving between the cathode and the anode. The deflection unit may be at least a dipol, a quadrupole, an octupol or the like. Dipoles may be preferred for angularly directing and guiding the electron beam. Quadrupoles may be preferred for shaping the electron beam. Octupoles may be further preferred for shaping the electron beam. The deflection unit may also comprise combinations thereof, as e.g. two dipoles and/or two quadrupoles.

Each deflection unit may comprise coils arranged at a yoke. The yoke may be made of and comprise only one piece to improve accuracy. Exemplarily, a combination of two quadropols arranged at two yokes is used, whereby additionally two dipoles are arranged at the second yoke in the direction of the electron movement. The quadropols may focus and shape the focal point, while the dipoles may position the focal point of the electrons at the anode.

In an example, the magnet system comprises a support tube surrounding the vacuum tube in an area of the drift way and housing the deflection unit. The support tube may be made of and comprise only one piece. The support tube may be fused and in particular welded to the other components of the X-ray unit. In contrast to the bottleneck, the support tube need not to have a small diameter and a low wall thickness. The support tube may have a much larger outer diameter in comparison to the drift way and also a much larger wall thickness. For example, the support tube may have an outer diameter of about 100 mm and a wall thickness of about 10 mm, while the surrounded bottleneck has an outer diameter of about 30 mm and a wall thickness of about 0.6 mm.

According to the present invention, also an X-ray system is presented. The X-ray system comprises the X-ray unit as described above, the cathode, and the anode. The X-ray unit comprises the vacuum tube and the magnet system. The cathode, the anode, and the drift way for an electron beam moving between the cathode and the anode are encased in the vacuum tube of the X-ray unit. The magnet system is configured to focus the electron beam and the magnet system is fused to the vacuum tube.

In an example, the magnet system surrounds the vacuum tube in an area of the drift way. In an example, the fusing of the magnet system to the vacuum tube is a welding. In an example, the magnet system comprises a deflection unit and a support tube surrounding the vacuum tube in an area of the drift way and housing the deflection unit. The deflection unit may be configured to magnetically deflect the electron beam moving between the cathode and the anode. The deflection unit may comprise two quadrupoles.

According to the present invention, also a method for manufacturing an X-ray system is presented. It comprises the following steps, not necessarily in this order: providing a vacuum tube, arranging a cathode and an anode within the vacuum tube to form a drift way for an electron beam moving between the cathode and the anode, providing a magnet system configured to focus the electron beam, and fusing the magnet system to the vacuum tube.

In an example, the fusing of the magnet system to the vacuum tube is a welding. In an example, the magnet system comprises a deflection unit and a support tube surrounding the vacuum tube in an area of the drift way and housing the deflection unit. The deflection unit may comprise two dipoles.

It shall be understood that the X-ray unit, the X-ray system, and the method for manufacturing such X-ray system according to the independent claims have similar and/or identical preferred embodiments, in particular, as defined in the dependent claims. It shall be understood further that a preferred embodiment of the invention can also be any combination of the dependent claims with the respective independent claim.

These and other aspects of the present invention will become apparent from and be elucidated with reference to the embodiments described hereinafter.

BRIEF DESCRIPTION OF THE DRAWINGS

Exemplary embodiments of the invention will be described in the following with reference to the accompanying drawings.

DETAILED DESCRIPTION OF EMBODIMENTS

Figure 1:
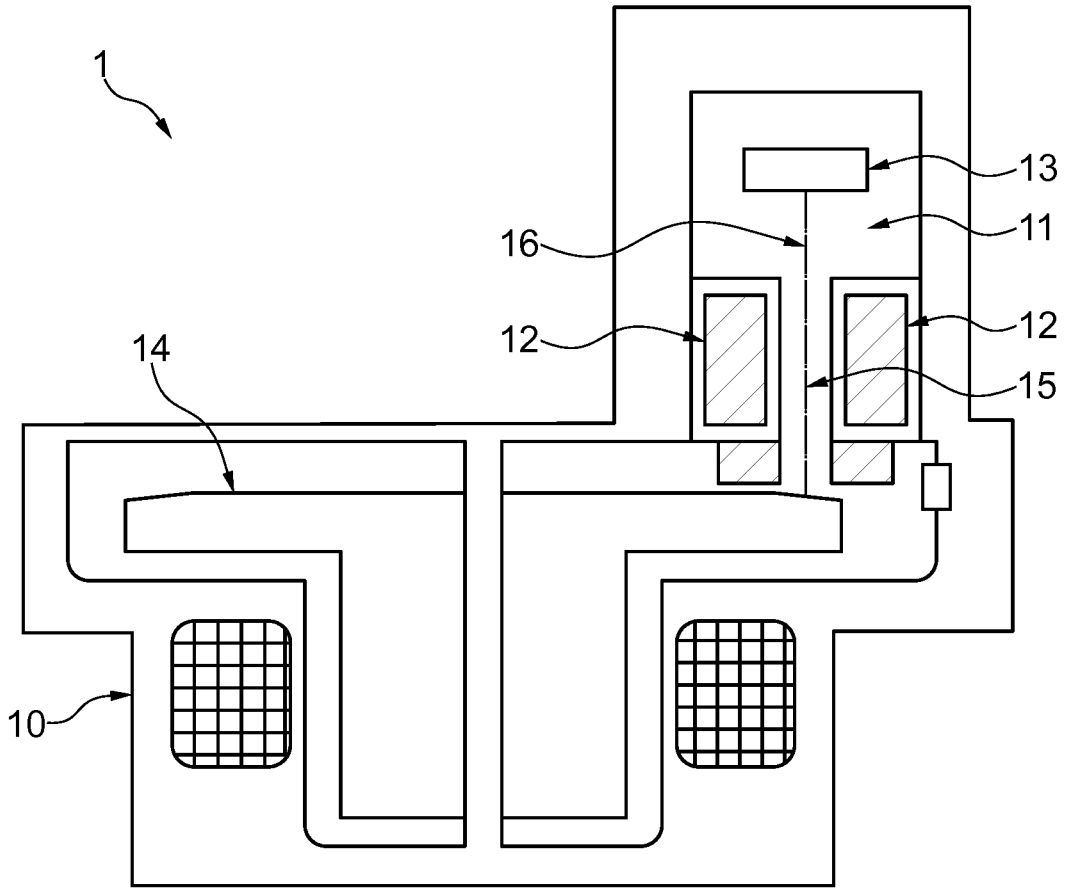
FIG. 1 shows schematically and exemplarily an embodiment of an X-ray system with an X-ray unit according to the invention.

FIG. 1 shows schematically and exemplarily an embodiment of an X-ray system 1 according to the invention. The X-ray system 1 comprises an X-ray unit 10, a cathode 13, and an anode 14. The X-ray unit 10 comprises a vacuum tube 11 and a magnet system 12. The vacuum tube 11 is configured to encase the cathode 13, the anode 14, and a drift way 15 for an electron beam 16 moving between the cathode 13 and the anode 14. The magnet system 12 focuses the electron beam 16 and surrounds the vacuum tube 11 in an area of the drift way 15. The magnet system 12 is fused and in particular welded to the vacuum tube 11.

Figure 2:
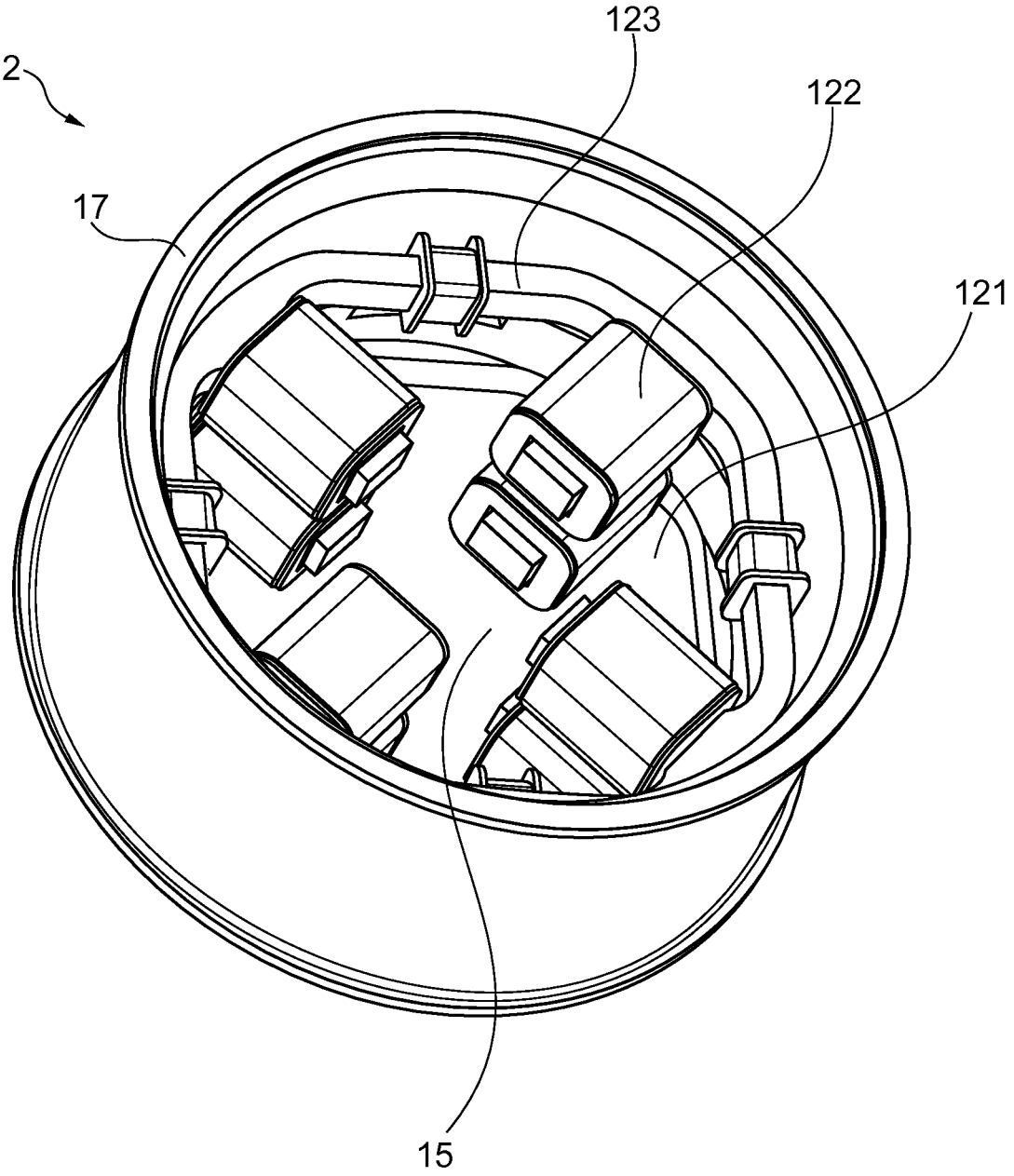
FIG. 2 shows a 3D visualization of the interior of a magnet system of the X-ray unit according to the invention.
Figure 3:
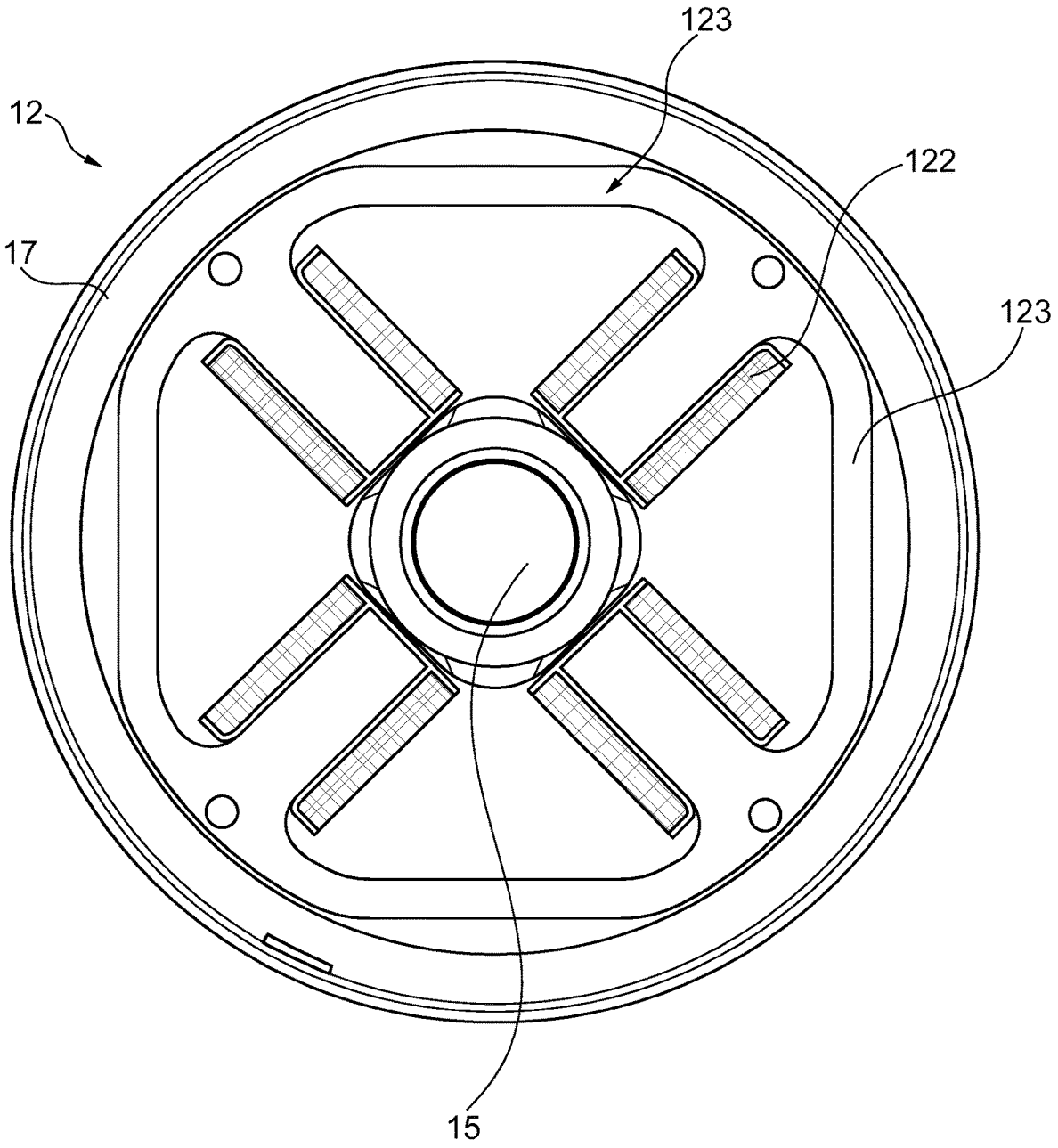
FIG. 3 shows a cross section of the magnet system of the X-ray unit according to the invention.

FIGS. 2 and 3 show schematically and exemplarily an embodiment of the magnet system 12. FIG. 2 shows a 3D visualization of the interior of the magnet system 12, while FIG. 3 shows a cross section of the magnet system 12. The magnet system 12 comprises a deflection unit 121 and a support tube 17.

The deflection unit 121 magnetically deflects the electron beam 16 moving between the cathode 13 and the anode 14. The deflection unit 121 is here a quadrupole and comprise four coils 122 arranged at a yoke 123. The yoke 123 is made of and comprises only one piece.

The support tube 17 surrounds the vacuum tube 11 in an area of the drift way 15 and houses the deflection unit 121. The support tube 17 is made of and comprises only one piece. The support tube 17 is fused and in particular welded to the other components of the X-ray unit 10.

Figure 4:
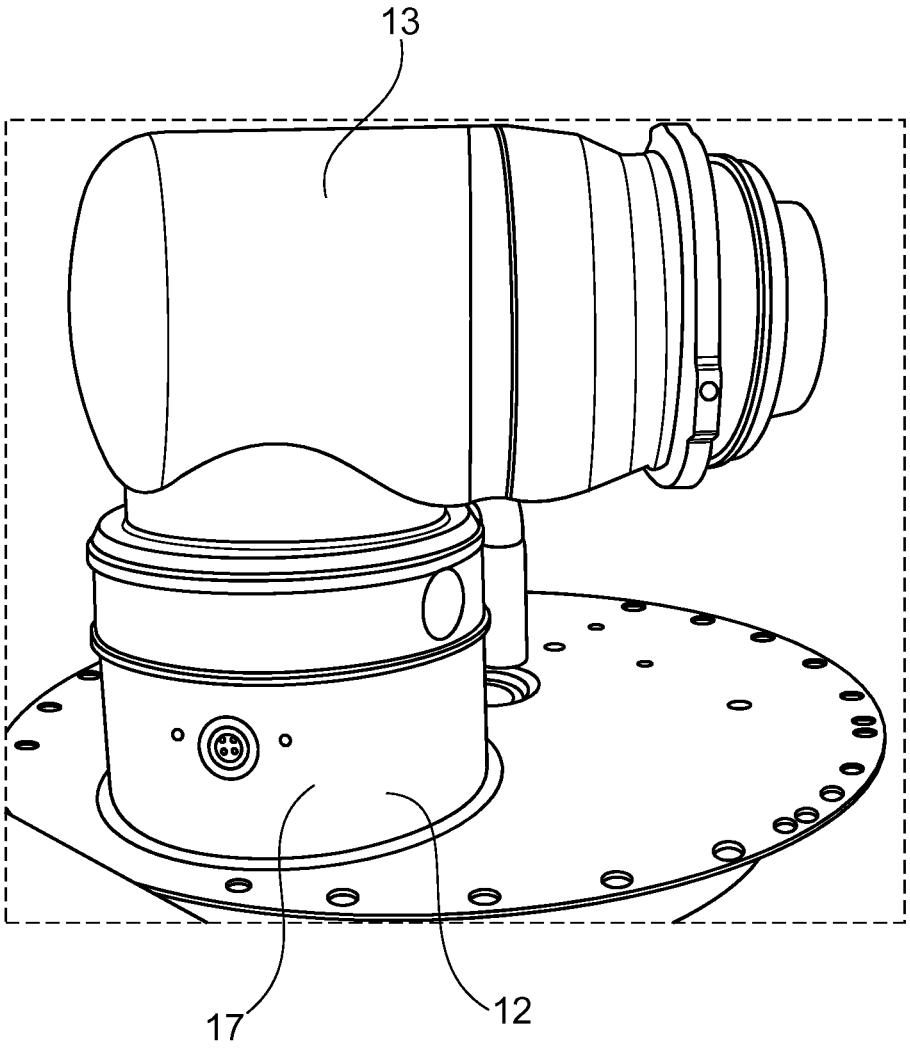
FIG. 4 shows a cathode and the magnet system of the X-ray system according to the invention.

The cathode 13 and the magnet system 12 are also shown in FIG. 4. In contrast to a conventional bottleneck, the support tube 17 need not to have a small diameter and a low wall thickness. The support tube 17 may have a much larger outer diameter in comparison to the bottleneck (not visible) and also a much larger wall thickness. For example, the support tube 17 may have an outer diameter of about 100 mm and a wall thickness of about 10 mm, while the surrounded bottleneck has an outer diameter of about 30 mm and a wall thickness of about 0.6 mm.

Figure 5:
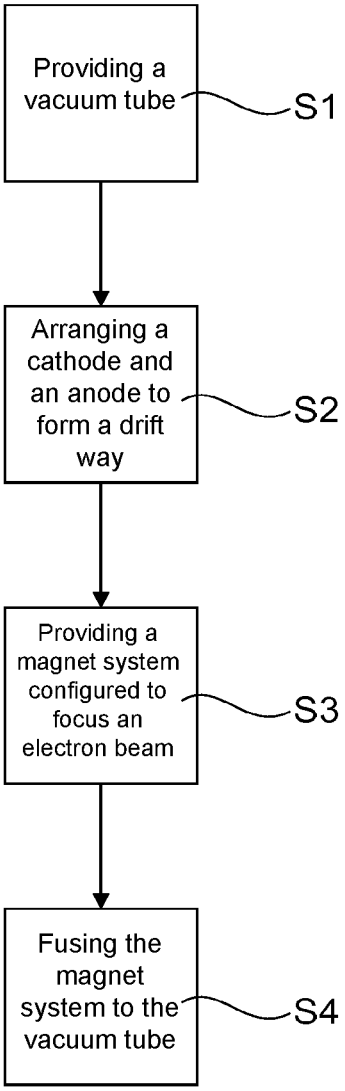
FIG. 5 shows a schematic overview of steps of a method for manufacturing an X-ray system according to the invention.

FIG. 5 shows a schematic overview of steps of a method for manufacturing an X-ray system 1 according to the invention. The method comprises the following steps, not necessarily in this order:

In a first step S1, providing a vacuum tube 11.

In a second step S2, arranging a cathode 13 and an anode 14 within the vacuum tube 11 to form a drift way 15 for an electron beam 16 moving between the cathode 13 and the anode 14.

In a third step S3, providing a magnet system 12 configured to focus the electron beam 16.

In a fourth step S4, fusing the magnet system 12 to the vacuum tube 11. Fusing may be understood in that the magnet system 12 is integrated into the vacuum tube 11, so that the magnet system 12 and the vacuum tube 11 are directly connected with each other and form only one part. For example, the magnet system 12 is welded to the vacuum tube 11 in an area of the drift way 15.

As a result, the stiffness in the area of the drift way 15 is greatly improved. The increased stiffness may allow a higher g-force stiffness of the cathode 13 in a CT gantry and a higher eigenfrequency. No sealing and elaborate positioning of single parts are necessary, while also a yoke 123 of the magnet system 12 can be one single, closed part. The accuracy is improved, while at the same time costs are reduced.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. An X-ray device, comprising:

a vacuum tube configured to encase a cathode and an anode to form a drift way for an electron beam moving between the cathode and the anode; and a magnet system configured to focus the electron beam, wherein the magnet system is a mono shell fused to the vacuum tube to directly connect the magnet system to the vacuum tube to form one part only, and wherein the magnet system surrounds the vacuum tube in an area of the drift way.

2. The X-ray device according to claim 1, wherein the magnet system is fused to the vacuum tube based on a local melting of a material of the vacuum tube.

3. The X-ray device according to claim 1, wherein the magnet system is welded to the vacuum tube.

4. The X-ray device according to claim 1, wherein the magnet system comprises a deflection unit configured to magnetically deflect the electron beam moving between the cathode and the anode.

5. The X-ray device according to claim 4, wherein the deflection unit comprises coils arranged at a yoke made of only one piece.

6. The X-ray device according to claim 4, wherein the deflection unit is at least one of a group comprising a dipole, a quadrupole, and an octupole.

7. The X-ray device according to claim 4, wherein the magnet system comprises a support tube surrounding the vacuum tube in an area of the drift way and housing the deflection unit.

8. The X-ray device according to claim 7, wherein the support tube is made of only one piece.

9. An X-ray system, comprising:

a cathode;

an anode; and an X-ray device comprising:

a vacuum tube configured to encase the cathode and the anode to form a drift way for an electron beam moving between the cathode and the anode; and a magnet system configured to focus the electron beam, wherein the magnet system is a mono shell fused to the vacuum tube to directly connect the magnet system to the vacuum tube to form one part only, and wherein the magnet system surrounds the vacuum tube in an area of the drift way.

10. A method of manufacturing an X-ray system, comprising:

providing a vacuum tube;

arranging a cathode and an anode within the vacuum tube to form a drift way for an electron beam moving between the cathode and the anode;

providing a magnet system configured to focus the electron beam, wherein the magnet system is a mono shell; and fusing the mono shell to the vacuum tube to directly connect the magnet system to the vacuum tube to form one part only, wherein the magnet system surrounds the vacuum tube in an area of the drift way.

* * * * *